US011208863B2

(12) United States Patent
Anthony et al.

(10) Patent No.: US 11,208,863 B2
(45) Date of Patent: Dec. 28, 2021

(54) MOBILE BALL LAUNCHER WITH FREE-FALL BALL RELEASE AND METHOD OF MAKING SAME

(71) Applicant: GR Energy Services Management, LP, Sugar Land, TX (US)

(72) Inventors: James William Anthony, Missouri City, TX (US); Marion M. Ringo, League City, TX (US); David Chesney, Houston, TX (US); Roma Montifar, Katy, TX (US); Thomas Bell, Houston, TX (US); Tyler Chaney, Houston, TX (US); Joel Henry, Manvel, TX (US); Ronald Craig Smith, Norman, OK (US); Steven Robert Olsen, Rosenberg, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 16/415,542

(22) Filed: May 17, 2019

(65) Prior Publication Data

US 2019/0301261 A1 Oct. 3, 2019

Related U.S. Application Data

(63) Continuation-in-part of application No. PCT/US2017/062317, filed on Nov. 17, 2017.

(Continued)

(51) Int. Cl.
*E21B 33/068* (2006.01)

(52) U.S. Cl.
CPC ..... *E21B 33/068* (2013.01)

(58) Field of Classification Search
CPC ..... E21B 33/068
See application file for complete search history.

(56) References Cited

U.S. PATENT DOCUMENTS 2,961,046 A * 11/1960 Moeller ..... E21B 33/068 166/75.15
3,039,531 A * 6/1962 Scott ..... E21B 33/068 166/70

(Continued)

FOREIGN PATENT DOCUMENTS

CA 2922319 A1 9/2016
WO 2015081092 A3 8/2015

OTHER PUBLICATIONS

CCSC Petroleum Equipment Co., Ltd Ball Injector Ball Dropper downloaded from the web at http://www.ccscpetro.com/ball-injector.html, dated at least as early as Aug. 26, 2017, p. 1.

(Continued)

*Primary Examiner* — Matthew R Buck
(74) *Attorney, Agent, or Firm* — J L Salazar

(57) ABSTRACT

A ball launcher and method for actuating wellsite equipment at a wellsite is disclosed. The wellsite has wellhead equipment positioned at an inlet of a wellbore. The ball launcher includes a housing, a ball release, and a housing extension. The housing has a passage for receiving balls. The ball is release positionable about the housing. The ball release includes a feeder to selectively and sequentially release the balls from the housing. The housing extension includes a hopper tube and a feed tube. The hopper tube has an inlet to receive the balls from the housing, the feed tube extending at an angle from the hopper tube. The feed tube has an exit a distance above the wellhead equipment to release the balls therethrough whereby the balls are dropped into and activates the wellsite equipment in the wellbore.

20 Claims, 13 Drawing Sheets

Related U.S. Application Data

(60) Provisional application No. 62/424,261, filed on Nov. 18, 2016.

(56) References Cited

U.S. PATENT DOCUMENTS

| | | | | |
|---|---|---|---|---|
| 3,372,705 | A * | 3/1968 | Bodhaine | E21B 33/068 137/268 |
| 3,779,270 | A * | 12/1973 | Davis | F16L 55/46 137/268 |
| 4,167,215 | A | 9/1979 | Thorne | |
| 5,205,359 | A * | 4/1993 | Stephenson | E21B 33/068 166/284 |
| 5,868,203 | A | 2/1999 | Cunningham | |
| 5,992,527 | A | 11/1999 | Garnham et al. | |
| 6,227,301 | B1 | 5/2001 | Edwards et al. | |
| 6,766,861 | B2 | 7/2004 | Koen et al. | |
| 7,571,773 | B1 | 8/2009 | West et al. | |
| 8,122,964 | B2 | 2/2012 | Judge et al. | |
| 8,136,585 | B2 | 3/2012 | Cherewyk | |
| 8,576,090 | B2 | 11/2013 | Lerche et al. | |
| 8,763,708 | B2 | 7/2014 | Travis et al. | |
| 9,109,422 | B2 * | 8/2015 | Ferguson | E21B 33/068 |
| 9,222,329 | B2 | 12/2015 | McGuire et al. | |
| 9,243,472 | B1 | 1/2016 | Snider et al. | |
| 9,644,446 | B2 * | 5/2017 | Bihun | E21B 33/068 |
| 9,670,745 | B1 | 6/2017 | Johansen et al. | |
| 2003/0051877 | A1 | 3/2003 | Koen et al. | |
| 2007/0284113 | A1 | 12/2007 | Haheim | |
| 2011/0168400 | A1 | 7/2011 | Machin et al. | |
| 2012/0024538 | A1 | 2/2012 | Britton | |
| 2012/0211219 | A1 | 8/2012 | McGuire et al. | |
| 2012/0279717 | A1 * | 11/2012 | Young | E21B 33/068 166/318 |
| 2013/0032327 | A1 | 2/2013 | He et al. | |
| 2014/0102717 | A1 * | 4/2014 | Cherewyk | E21B 33/10 166/381 |
| 2015/0034296 | A1 | 2/2015 | McGuire et al. | |
| 2015/0047826 | A1 | 2/2015 | McGuire et al. | |
| 2015/0275624 | A1 | 10/2015 | Coles et al. | |
| 2016/0273295 | A1 | 9/2016 | Rahim et al. | |
| 2016/0290087 | A1 * | 10/2016 | Cherewyk | E21B 33/05 |
| 2017/0022777 | A1 | 1/2017 | Allen et al. | |

OTHER PUBLICATIONS

GE Oil & GAS, Shale 360 Services Veloca Atmospheric Ball Launching System brochure downloaded from the web at https://www.bhge.com/sites/default/files/2018-04/ge_oil_gas_veloca_atmospheric_ball_launching_system.pdf, dated at least as early as Aug. 26, 2017, pp. 1-2.

Halliburton Pneumatic Ball Launcher brochure downloaded from the web, dated at least as early as Aug. 26, 2017, p. 1.

Isolation Equipment Services XL Series Ball Launching Systems Brochure, downoaded from the web at http://www.isolationequipment.com/brochures/Brochure_Ball_Launcher.PDF, dated at least as early as Aug. 26, 2017, pp. 1-5.

Oil States Energy Services Ball Launchers brochure downloaded from the web at http://www.oses.com/products-and-services/ball-launchers-1450.html, dated at least as early as Aug. 26, 2017,pp. 1-7.

Performance Wellhead & FRAC Components Safelaunch Ball Injection System brochure downloaded from the web at www.pwfrac.com, dated at least as early as Aug. 26, 2017, pp. 1-3.

Stinger Wellhead Protection (Canada) Inc. Sure Drop Ball Launcher brochure downloaded from the web at http://www.schoonerpetroleum.com/stinger/canada/products/ca_ballLauncher.html, dated at least as early as Aug. 26, 2017, pp. 1-2.

Stream-Flo Patented Ball Dropper webpage downloaded from the web at https://www.streamflo.com/en/wellhead-valve-services-frac-support/ball-drop-wellhead-isolation/, dated at least as early as Aug. 26, 2017, p. 1.

Weir Seaboard Canada Seaboard Ball Launching System brochure downloaded from the web at https://www.global.weir/assets/Seaboard%20Ball%20Launching2017.pdf, dated at least as early as Aug. 26, 2017, pp. 1-2.

GR Energy Services, RigLock Remote Wellhead Rig-up/Rig-down Equipment, dated at least as early as Nov. 18, 2016, pp. 1-2.

WIPO, International Search Report for PCT/US2017/062317 dated May 24, 2018, pp. 1-5.

Written Opinion for PCT/US2017/062317 dated May 24, 2018, pp. 1-7.

* cited by examiner

MOBILE BALL LAUNCHER WITH FREE-FALL BALL RELEASE AND METHOD OF MAKING SAME

CROSS-REFERENCE TO RELATED APPLICATIONS

The application is a continuation in part of PCT Application No. PCT/US2017/062317 filed on 17 Nov. 2017, which claims the benefit of U.S. Provisional Application No. 62/424,261, filed on Nov. 18, 2016, the entire contents of which are hereby incorporated by reference herein.

BACKGROUND

This present disclosure relates generally to oilfield technology. More specifically, the present disclosure relates to wellsite equipment used to perform wellsite operations and/or actuators used therewith.

Wellbores are drilled to reach subsurface fluids and produce valuable fluids, such as oil and gas. Rigs are positioned at wellsites to deploy drilling equipment into the earth to form the wellbores. The drilling equipment includes a drill bit advanced by a drill string into the earth. Once the wellbore is formed, a casing may be lowered into the wellbore and cemented in place to line the wellbore. A wellhead is provided at an inlet of the wellbore to support the casing. Examples of wellheads are provided in US Patent/Application Nos. 2003/0051877, 2011/0168400, 4167215, 5868203, 6766861, and 8763708, the entire contents of which are hereby incorporated by reference herein.

After drilling, the well or wells on a pad may undergo completion activities intended to stimulate the formation to produce fluids into the wellbore. Such activities may utilize fracture wellheads and stimulation equipment to deploy completion tools into the wellbore to perforate the wellbore, inject stimulation fluids, and produce formation fluids.

Once wellbores are drilled, production equipment may be positioned at the wellsite to produce fluid from subsurface reservoirs to the surface. The production equipment may include, for example, tubing deployed into the wellbore to pass fluids to the surface, and a Christmas tree positioned on the wellhead to control fluid flow. Other equipment, such as blowout preventers may also be provided about the wellhead. Examples of production equipment are provided in US Patent/Application Nos. 2007/0284113, 2012/0024538, 20150275624, 5992527, 6277301, 9243472, the entire contents of which are hereby incorporated by reference herein.

Despite the advancements in wellsite equipment, there remains a need to efficiently and safely facilitate actuation of the wellsite equipment. The present disclosure is intended to provide such needs.

SUMMARY

In at least one aspect, the disclosure relates to a ball launcher for actuating wellsite equipment at a wellsite. The wellsite has wellhead equipment positioned at an inlet of a wellbore. The ball launcher comprises a housing, a ball release, and a housing extension. The housing has a passage for receiving balls. The ball release is positionable about the housing, and comprises a feeder to selectively and sequentially release the balls from the housing. The housing extension comprises a hopper tube and a feed tube. The hopper tube has an inlet to receive the balls from the housing. The feed tube extends at an angle from the hopper tube, and has an exit a distance above the wellhead equipment to release the balls therethrough whereby the balls are dropped into and activates the wellsite equipment in the wellbore.

The ball release may comprise a drive system. The feeder may comprise an auger and the drive system may comprise a motor and a gearbox. The feeder may comprise a rotary wheel and the drive system may comprise a motor.

The ball launcher may also comprise an indication unit comprising an enclosure, a receiver, a signal indicator, and a battery. The enclosure may comprise an explosion proof chamber with an opening and a window positioned over the opening.

The ball launcher may also comprise an external unit comprising a charging unit connectable to the battery, a ball release indicator positioned about the housing and movable to an activation position by each of the balls passing thereby, and a mounting bracket. The housing further comprises a cartridge positionable in the housing.

In another aspect, the disclosure relates to an activation system for actuating wellsite equipment at a wellsite. The wellsite has wellhead equipment positioned at an inlet of a wellbore. The activation system comprises balls, hoisting equipment, and a ball launcher. The hoisting equipment is positionable about the wellsite. The housing has a passage for receiving balls. The ball release is positionable about the housing, and comprises a feeder to selectively and sequentially release the balls from the housing. The housing extension comprises a hopper tube and a feed tube. The hopper tube has an inlet to receive the balls from the housing. The feed tube extends at an angle from the hopper tube, and has an exit a distance above the wellhead equipment to release the balls therethrough whereby the balls are dropped into and activates the wellsite equipment in the wellbore.

The activation system further comprising a remote activator to send a release signal to the ball release, an indication unit comprising a receiver to receive the release signal and a driver coupled to the receiver, an external unit, and a surface unit. The driver comprises a motor to drive the feeder in response to the release signal. The surface unit coupled to the ball release, and comprising a processor, a database, and a transceiver. The wellsite equipment comprises packers positioned in a wellbore at the wellsite. Each of the packers has a passage to receive the balls.

Finally, in another aspect, the method of actuating wellsite equipment at a wellsite. The wellsite has wellhead equipment positioned at an inlet of a wellbore. The method comprises mounting a ball launcher to hoisting equipment at the wellsite, placing balls in a housing, selectively and sequentially releasing the balls from the housing, slowing a speed of the balls by passing the balls from the housing through an angled housing extension positioned a distance above the wellhead, and activating the wellsite equipment by dropping the balls from the angled housing extension and through the wellhead.

The method may further comprise connecting an extension housing to the housing and releasing the balls from the housing through the housing extension. The selectively releasing may further comprise sending an activation signal from a remote location to the ball launcher. The method may further comprise isolating a portion of the wellbore by passing the balls through a passage in wellbore equipment in the wellbore and seating the balls in at least a portion of the passage in the wellsite equipment.

BRIEF DESCRIPTION OF THE DRAWINGS

So that the features herein can be understood in detail, a more particular description may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

DETAILED DESCRIPTION

In the following description, numerous details are set forth to provide an understanding of the present disclosure. However, it will be understood by those skilled in the art that the present disclosure may be practiced without these details and that numerous variations or modifications from the described embodiments are possible.

The present disclosure relates to a wellsite actuator usable for actuating wellsite equipment. The wellsite actuator may be in the form of ball launcher including a housing positionable about the wellbore and balls deployable from the housing by a ball release. The wellsite actuator may be used, for example, to release the balls into the wellbore to perform functions, such as actuating wellsite equipment and/or isolating portions of the wellbore for stimulation. The wellsite actuator may include a ball release in a wheel, auger, or other configuration for cycling balls for release. The ball release may be provided with an extension housing positionable above the wellhead to reduce a speed of the ball during release.

The wellsite actuator may be positionable at the wellsite in a location, such as about a wellhead, pressure control assembly, deployable equipment, and/or other wellsite equipment, for deployment of balls into the wellbore. The wellsite actuator may be activated from a position a distance away from the wellbore, such as in a safe zone away from moving equipment. The wellsite actuator may also be remotely actuatable by a remote control for activation a distance from the wellhead, such as a safe zone beyond moving equipment. A configuration of the wellsite actuator may be defined to provide flexible operation, modularity, movability, selective positioning, selective release, remote control, safe operation, timed operation, attachment to existing equipment, and/or other features.

Figure 1:
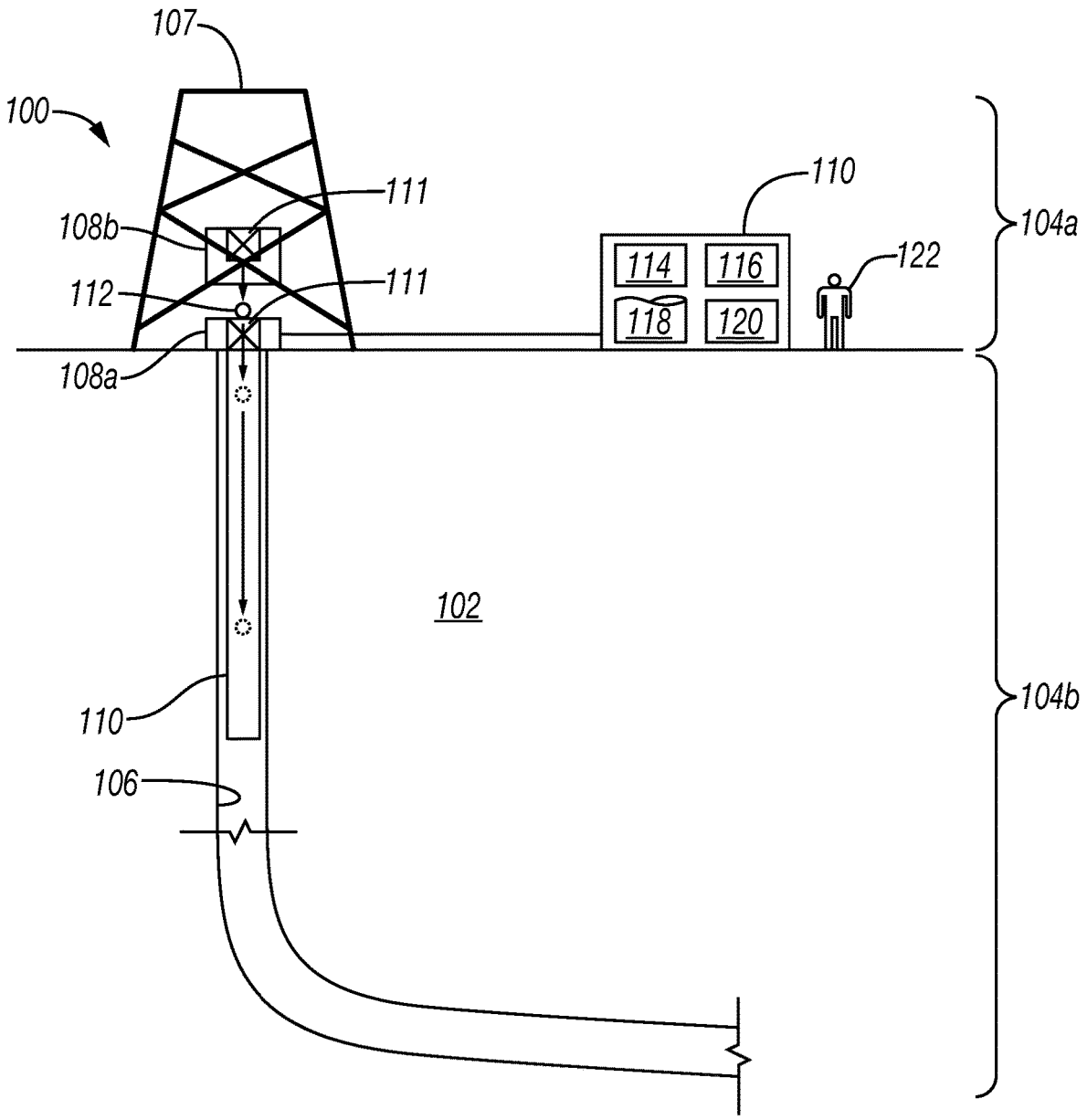
FIG. 1 is a schematic diagram of a wellsite having wellsite equipment including surface equipment, downhole equipment, and a wellsite actuator.

FIG. 1 is a schematic diagram of a wellsite 100 positioned about a subsurface formation 102 for producing subsurface fluids. The wellsite 100 includes surface equipment 104*a* and downhole equipment 104*b* positionable about a wellbore 106. The wellbore 106 may extend into the formation 102 in various configurations, such as the deviated wellbore 106 as shown. While the wellsite 100 is depicted as a land based wellsite, any wellsite (e.g. onshore or offshore) may be used.

In the example shown, the surface equipment 104*a* includes a hoisting equipment 107 and wellsite components 108*a*,108*b* positioned about an inlet of the wellbore 106. The hoisting equipment 107 may be any equipment positionable at the surface for supporting the wellsite component(s) 108*a,b*. For example, the hoisting equipment 107 may be a rig, crane, mast or other device at the surface for supporting the wellsite component(s) 108*a,b*.

The wellsite component 108*a,b* may be any component supportable at the wellsite 100 by the hoisting equipment 107, such as drilling (e.g., drilling rig, pipe handler, Kelly, rotary table, elevator, etc.), wireline (e.g., cable head, cable, slickline, wireline, pressure control equipment, etc.), coiled tubing (e.g., injection trucks, pump units, blenders, etc.), completion (fracture pumps, fracture support equipment, wellhead, cement pumps, mud pumps, casing support, etc.), production (e.g., Christmas tree, blowout preventer, etc.), and/or other wellsite equipment.

As shown, the wellsite component 108*a* is a wellhead (or wellhead equipment) positioned at an inlet of the wellbore 106 with a wellsite component 108*b* positioned thereabove. The wellsite component 108*b* may be supported by the hoisting equipment 107 or other equipment, and may be movably positioned about the wellhead 108*a* for use a distance from or in connection with the wellhead 108*a*.

The downhole equipment 104*b* may include a downhole tool 110 positionable in the wellbore for performing wellsite operations. The downhole equipment 104*b* may be, for example, wireline tool (e.g., probe, sampler, measurement tool, etc.), stimulation tool (e.g., injector, perforator/perforation tool, etc.), completion tool (e.g., cementer, casing string, etc.), production tool (e.g., production tubing, packers, etc.), and/or other wellsite equipment.

The wellsite 100 also includes a wellsite actuator 111 for actuating surface and/or downhole equipment 104*a*,104*b*. The wellsite actuator 111 is shown as a device, such as a ball launcher, capable of deploying a ball 112 into the wellbore 106. The ball 112 may be deployable into the wellbore 106 and/or shaped for operation with one or more portions of the surface and/or downhole equipment 104 *a,b* as is described further herein. As also shown, the wellsite actuator 111 may be positioned about various portions of the wellsite 100 for connection to and/or operation with the various surface and/or downhole equipment 104*a*,104*b*.

The surface and downhole equipment 104*a*,104*b* may be coupled to a surface unit 115 for operation therewith. The surface unit 115 may include a central processing unit (CPU) (or processor) 114, input/output device (e.g., monitor, keyboard, mouse, etc.) 116, database 118, transceiver 120, and/or other devices for operation with the surface and downhole equipment 104*a*,104*b*. The surface unit 115 may be in communication with the wellsite actuator 111 for selective operation therewith and/or to monitor performance thereof. The surface unit 115 may have an operator 122 or be automated.

While a specific configuration of a wellsite and a wellsite actuator 111 are depicted, it will be appreciated that variations of the wellsite 100 and wellsite actuator 111 may be provided. For example, the wellsite actuator 111 may be positioned about various equipment for performing various actuation operations. The wellsite actuator s and/or ball launchers described herein are intended to provide a means for activation of wellsite equipment from a remote and/or safe location a distance from moving equipment at the wellbore, such as from a distance greater than about 60 feet (18.29 m). The ball launcher as described herein may be provided with various features, such as a mobile housing, remote actuator, various sized balls, ball magazines receivable in the housing, and/or other features.

Figure 2A:
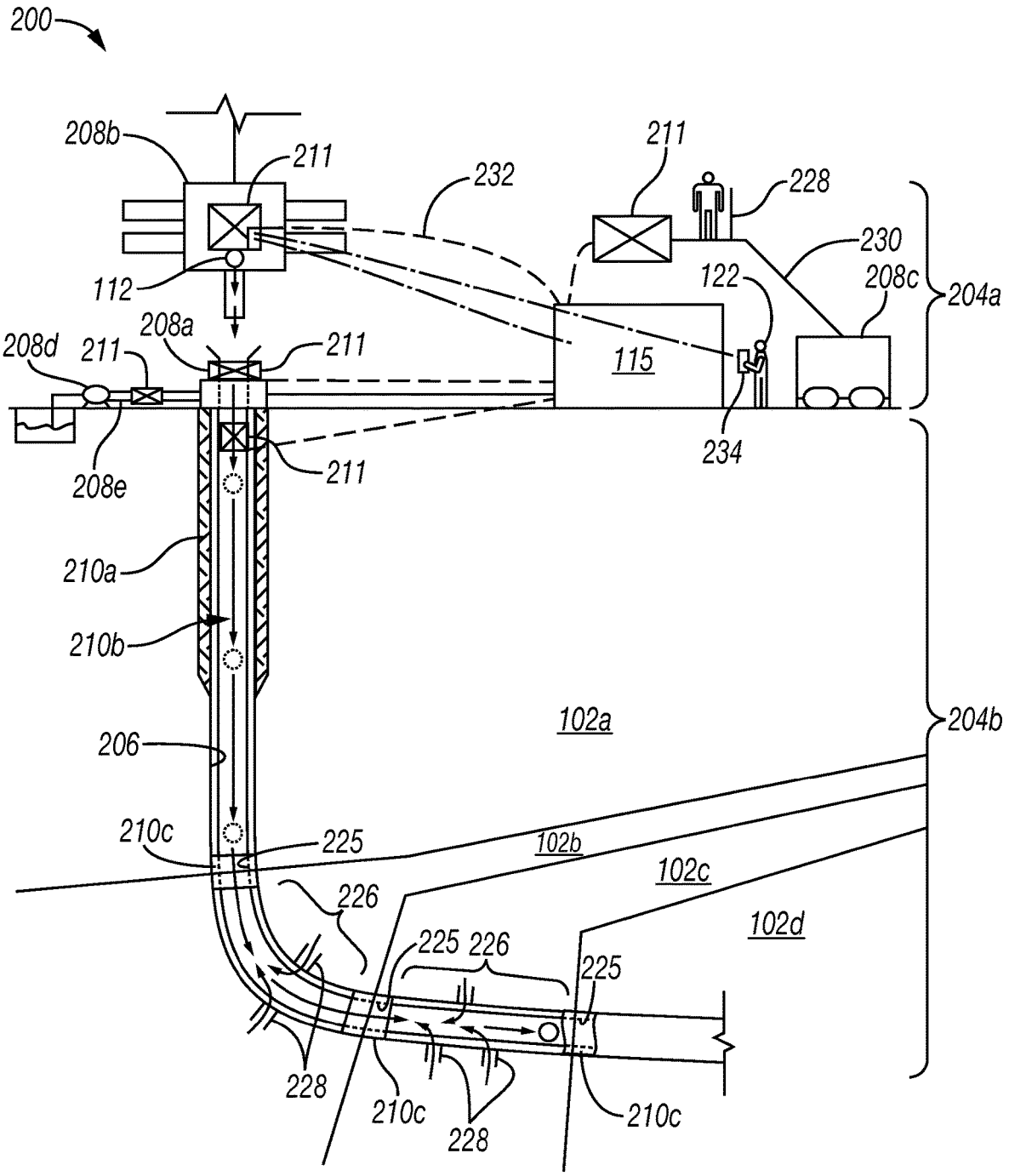
FIGS. 2A and 2B are schematic diagrams depicting the wellsite having various configurations of the wellsite equipment including a wellhead, downhole packers/plugs, and a ball launcher.
Figure 2B:
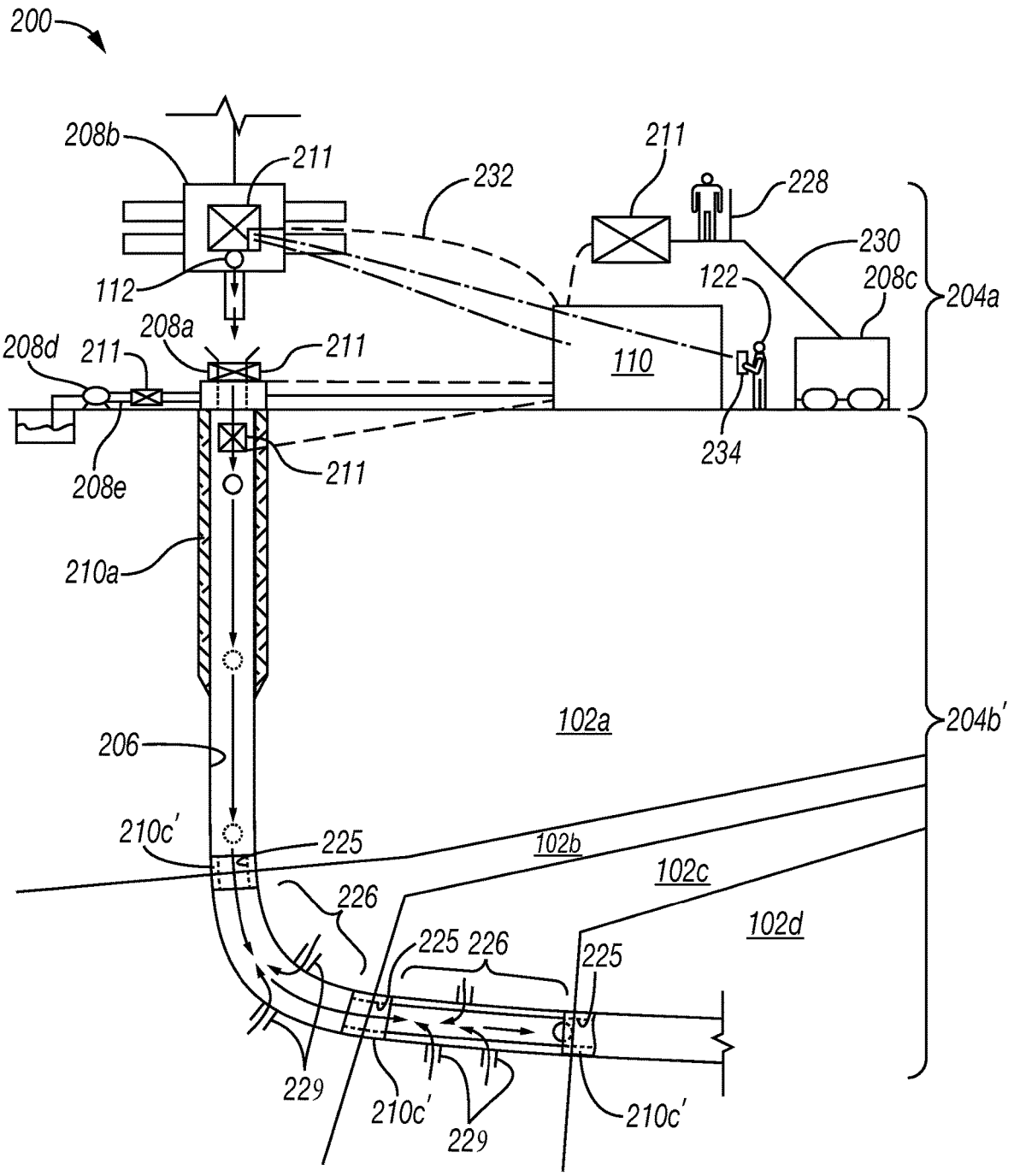

FIGS. 2A and 2B show an example configuration of ball launcher 211 usable as the wellsite actuator 111 of FIG. 1. FIG. 2A is a schematic diagram of a wellsite 200 including surface equipment 204*a* and downhole equipment 204*b* positionable about a wellbore 206. FIG. 2B shows another version of the wellsite 200 with the same surface equipment 204*a* and different downhole equipment 204*b'*.

In the example of FIG. 2A, the surface equipment 204*a* includes a wellhead 208*a* and pressure control equipment 208*b* positioned at an inlet of the wellbore 206. The pressure control equipment 208*b* may be, for example, a Christmas tree, blowout preventer, and/or other equipment connectable to the wellhead 208*a*. The surface equipment 204*a* is also shown as including an optional transporter 208*c* movably positionable about the wellsite 200. Other equipment, such as pump 208*d* and related flowlines 208*e* for pumping fluid into the wellbore 206, may also optionally be provided. Also, while a spherical ball 112 is depicted herein, it will be appreciated that various shaped balls or other projectiles may be passed through the ball launcher 211 for activation.

The downhole equipment 204*b* may be in the form of production equipment including a casing 210*a*, a tubing 210*b*, and packers 210*c*. The casing 210*a* is deployable into and supported in the wellbore 206 by the wellhead 208*a* and cement. The tubing 210*b* and packers 210*c* are deployable into the wellbore 206 for performing production and/or completion operations, such as passing fluids from subsurface locations to the surface for collection and/or pumping fluids downhole from surface.

As also shown in FIG. 2A, the formation 102 may have multiple strata 102*a-d* defined by structures in the formation. These strata 102*a-d* may align to portions of the wellbore 106 referred to as pay zones 226 at different depths in the wellbore 106. The wellbore 106 may be perforated along the various pay zones 226 to facilitate the flow of fluid from the respective strata 102*a-d* into their pay zones 226. Perforations 229 placed along the casing 210*a* and/or wellbore 106, for example, by a perforating tool (e.g., 110 of FIG. 1), may be used to pass fluid into or out of the wellbore 206. Stimulation fluids may be injected through the perforations to open fractures in the formation to facilitate flow of fluid into the pay zones.

During fracturing operations these pay zones 226 must be isolated one from another by inserting various devices, such as the packers 210*c* into the wellbore 106. The packers 210*c* may be deployed via the tubing 210*b* into the wellbore 206 and expanded therein to isolate the pay zones (or stages) 226 of the wellbore 206. A fluid passing into isolated pay zones 226 of the wellbore 206 between the packers 210*c* may be drawn into the tubing 210*b* and brought to the surface.

The packer 210*c* may have a passage 225 therethrough that remains open until actuated to move to a closed position to define the isolated zones 226. This may be done by placing the ball 112 in the wellbore 106 to occlude a bore inlet of the packer 210*c* to block fluid flow therethrough. During operation, high pressure stimulation (fracture) fluids passing from the formation and into the pay zones are isolated between occluded packers 210*c*, thereby preventing such fluid from passing into other pay zones. This may be used to direct fluids entering pay zones above the occluded packers to receive all the stimulation fluid, while permitting other pay zones to receive fluids from certain of the strata 102*a-d*.

The ball launcher 211 may be positioned about the wellsite 100 to deploy balls 112 into the wellbore 206. The ball launcher 211 may be positioned about the wellhead 208*a* to deploy the ball 112 therethrough. In this example, the ball launcher 211 may be positioned along one or more pieces of the wellsite equipment, such as the wellhead 208*a*, the pressure control equipment 208*b*, the flowline 208*e*, the transporter 208*c*, and the packers 210*c*.

When positioned about the pressure control equipment 208*b*, the ball launcher 211 may be positioned a distance above the wellhead 208*a* and activated such that the ball 112 free-falls from the ball launcher 211 and into the wellbore 206. For example, the transporter 208*c* may be used to carry the ball launcher 211 from a position away from the wellhead 208*a* to a position above the wellhead 208*a* to release the ball 112 therefrom. The transporter 208*c* may be a manned or unmanned device with a carrier 228 to support and position the ball launcher 211 above the wellhead 208*a*. The carrier 228 may be extendable into position by an arm 230.

The ball launcher 211 releases the ball 112 through the wellhead 208*a* and through tubing 210*b*. The packers 210*c* and balls 112 may be sized such that the ball 112 passes through the desired packers 210*c* and seats in a select one of the packers 210*c*. Once seated, the ball 112 closes the packer and isolates a downhole portion of the wellbore 206 from an uphole portion of the wellbore 206 on either side thereof.

The surface unit 115 may be used to power, monitor, measure, and/or otherwise operate the surface and/or downhole equipment 204*a,b* and/or the ball launcher 211. As schematically shown, the surface unit 115 may be coupled to the ball launchers 211 and/or the downhole equipment 204*a,b* by communication links 232 for operation therewith.

An activator 234 is optionally provided to signal the ball launcher 211 to release the ball 112. As also schematically shown, the activator 234 may be activated by the surface unit 115 and/or by the operator 122. The activator 234 may be, for example, a signaling device capable of activating the ball launcher 211 to release the ball 112 as is described further herein (see, e.g., activator 350 of FIGS. 3A-3C). One or more operators 122 (located onsite and/or offsite) may be in communication with the surface and/or downhole equipment 204*a*,204*b*, the activator 234, and/or the ball launcher 211 directly and/or via the surface unit 115.

The example of FIG. 2B is similar to FIG. 2A, except that plugs 210*c'* have been deployed into the wellbore 106 and inserted therein and no tubing 210*b* is present. The plugs 210*c'* may be installed and set along portions of the wellbore 106 using a downhole tool (e.g., 110 of FIG. 1). Examples of plugs and/or plugging is provided in US Patent/Application Nos. 9243472 and 20150275624, previously incorporated by reference herein. As with the packers 210*c* of FIG. 2A, the plugs 210*c'* may be positioned such that, once occluded by placement of a ball 112 into an inlet thereof, fluid is isolated from passing therethrough.

As shown by FIGS. 2A and 2B, various equipment may be used at the wellsite for selective activation by the wellsite actuator (e.g., ball launcher) 211. As shown by these examples, the wellsite actuator may deploy a ball 112 to block flow through a packer, plug and/or other device to define isolated zones along the wellbore 106 to selectively isolate flow therein.

Figure 3A:
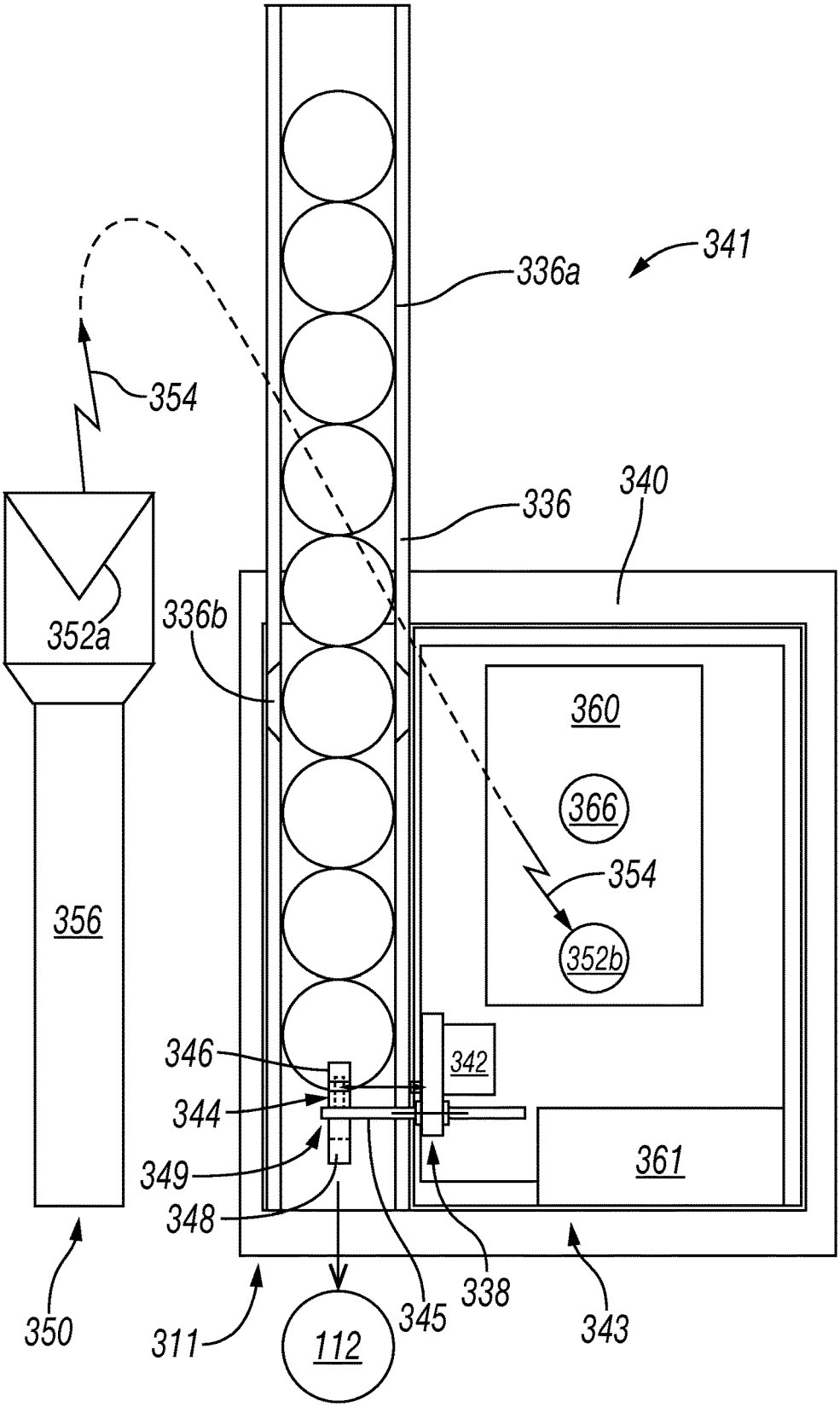
FIGS. 3A-3C are schematic diagrams depicting the ball launcher in a wheel configuration.
Figure 3B:
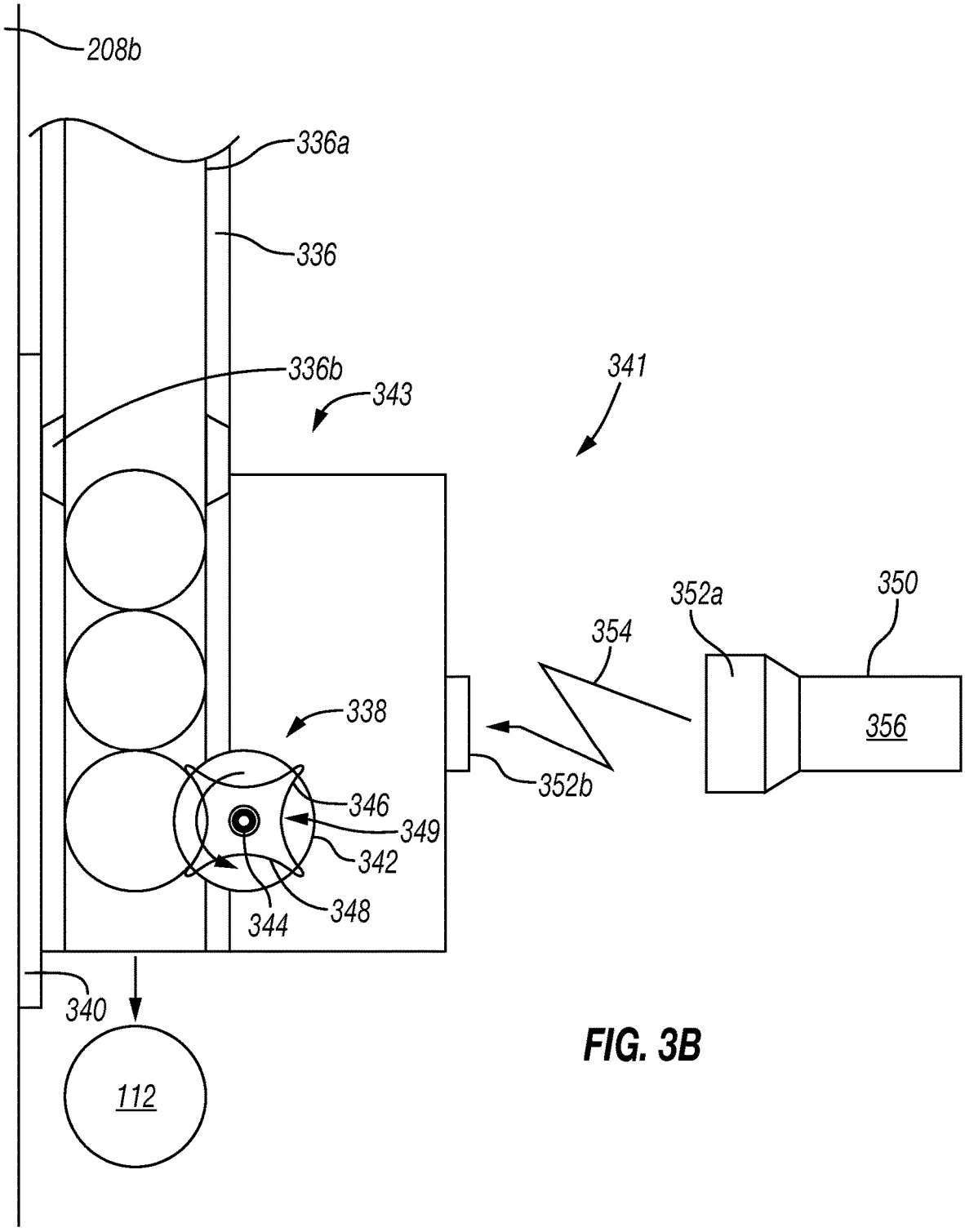
Figure 3C:
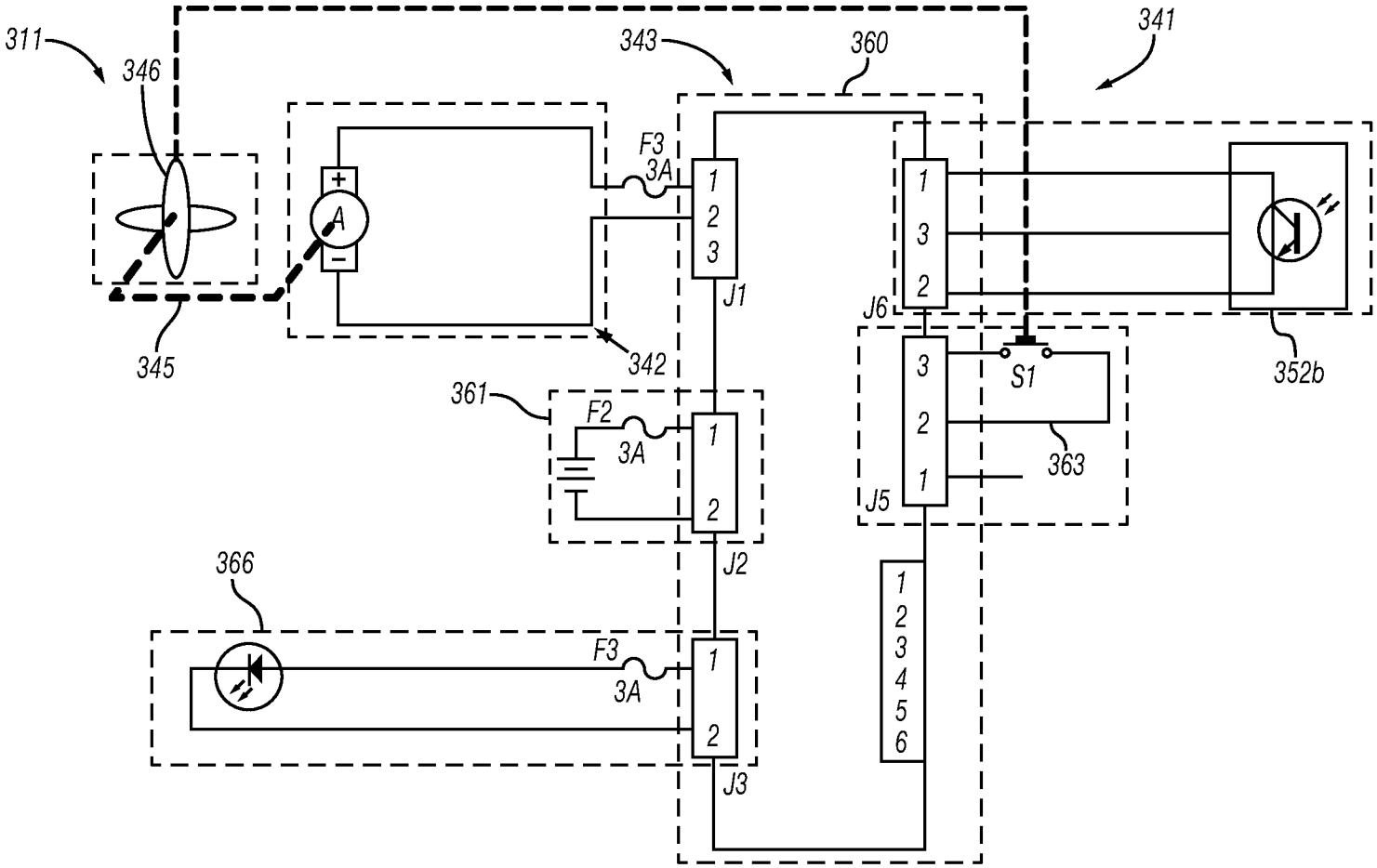

FIGS. 3A-3C show detailed views of an example launching system 341. The launching system 341 includes a ball launcher 311 usable as the wellsite actuator 111 and/or ball launcher 211 of FIGS. 1 and 2, respectively. As shown in FIG. 3A, the ball launcher 311 includes a housing 336, a ball release 338, and a bracket 340. The housing 336 may be any container capable of supporting a desired number of the balls 112 therein. The housing 336 may be, for example, a container capable of supporting the balls 112 in a stacked position to be dropped sequentially from the housing 336. The housing 336 may have an inlet at an upper end to receive and/or store the balls 112, and an outlet at a lower end for gravitational release of the ball 112 therefrom. The inlets/outlets may optionally have doors that selectively open/close for input/release of the balls 112.

The housing 336 may be supported on the various surface and/or downhole equipment by the bracket 340. The bracket 340 as shown may be used to attach the ball launcher 311 to the pressure control equipment (e.g., 208*b* FIG. 2) for release therefrom. Various connectors, handles, supports, and/or other devices may be used to support the housing 336 as needed. As also shown in FIG. 3B, the balls 112 may be carried by a ball magazine 336*a* removably insertable into the housing 336. Optional framing 336*b* may be provided to receivably support the ball magazine 336*a* in the housing 336.

The ball release 338 may include a feeder 349 and a driver 342. The feeder 349 may be a device capable of selectively releasing one or more balls 112 from the ball launcher 311. For example, the feeder 349 may be a wheel 344 with paddles 346 extending radially therefrom. The paddles 346 may define a pocket 348 to receive one of the balls 112 therein. The wheel 344 may be rotationally mounted to the housing 336 to rotate the balls 112 from an upper portion of the housing 336 where the balls 112 are stored to a lower portion of the housing 336 for release therefrom.

The driver 342 may be, for example, a motor (e.g., electric, hydraulic, etc.) with a shaft 345 coupled to the feeder 349. The driver 342 may be capable of rotating the wheel 344 via the shaft 345 to advance the balls 112 about the housing 336 for release from the housing 336. The driver 342 may be cycled between positions to selectively rotate the wheel 344 to permit release of the balls 112 as desired.

The ball launcher 311 may also include an activator 350 for selectively activating the driver 342 to rotate the wheel 344 and advance the balls 112 for release. The activator 350 may be any device capable of signaling the driver 342 and/or wheel 344 to release the ball(s) 112 as demonstrated by the activator 234 of FIGS. 2A and 2B. The activator 350 may be, for example, a signal transceiver (signal eye) 352*a* and/or receiver 352*b*, such as an optical, laser, radio, infrared, and/or other signal device capable sending and receiving a signal that activates the driver 342 and/or wheel 344.

As shown in FIGS. 3A and 3B, the signal activator 350 may include a signal eye (e.g., optical, laser, infrared, etc.) 352*a* capable of emitting a signal (e.g., laser, light, beam, etc.) 354 receiveable by an optical receiver 352*b* as indicated by the dashed line. The signal eye 352*a* may be carried by a remote control 356 usable by the operator (e.g., 112 of FIG. 2). The activator 350 may be coupled the surface unit 115 for communication therewith.

The surface unit 115 may be used to monitor and/or control the activator 350 and/or portions of the ball launcher 311. The surface unit 115 may be used to selectively operate the ball launcher 311 to selectively release the ball(s) 112 as needed for wellsite operations. The ball launcher 311 may optionally be timed for release to achieve desired operations. Part or all of the ball launcher 311 and/or signal activator 350 may be operated using various devices, such as an indication unit including a computer system 360, power supply 361, indicator 366, and/or other features (e.g., battery power, remote control, etc.) as is described further herein.

FIG. 3C is a schematic electrical diagram depicting the launching system 341 in greater detail. As shown in this view, the launching system 341 includes the ball launcher 311 and the driver system 343. The ball launcher 311 is electrically coupled to the driver system 343. The driver system 343 includes the receiver 352*b*, the driver 342, and the computer system 360. The computer system includes or is coupled to the power supply 361, the indicator 366, and a switch 363. Other components may also be provided, such as sensors, displays, input/output devices, circuit boards, junctions (e.g., J1-J3, J5-J6), filters (e.g., F2-F3), etc.

The receiver 352*b* is depicted as an optical receiver capable of detecting an optical signal from the signal transceiver (signal eye) 352*a* (FIGS. 3A-3B). The optical receive may be, for example, a phototransistor capable of detecting an optical (e.g., infrared) signal from the signal eye 352*a*. Upon detection of the optical signal, the optical receiver 352*b* sends a signal to the computer system 360. The signal from the receiver 352*b* causes the computer system 360 to activate the driver 342. The computer system 360 may be or include, for example, a central processing unit (CPU) coupled to the driver 342 for selective activation thereof.

The driver 342 may be, for example, a conventional electrical motor with servo capabilities. As shown in this view, the ball release 338 is coupled by a shaft 345 to the driver 342. The driver 342 as shown is a motor (e.g., servo motor) capable of rotationally driving the ball release 338 via the shaft 345 to rotate the paddles 346.

The computer system 360 may be electrically coupled to the power supply 361 and the indicator 366. The power supply 361 may be a battery (e.g., 9V) electrically connected to the computer system 360 to provide power thereto. The receiver 352*b*, driver 342, indicator 366 and/or other parts of the computer system 360 may also be powered by the power supply 361. The indicator 366 may be, for example, a light emitting diode (LED) which may light (e.g., flash, color, etc.) to indicate an event, such as low battery or normal operation of the driver 342.

The switch 363 may be an electrical device, such as a cam actuated microswitch activated by operation of the driver 342 and/or the ball release 338. The switch 363 may be electrically connected to the paddle 346 and/or wheel 344 to detect a position thereof. The switch 363 may detect, for example, when the paddle 346 advances to a predefined position, such as a position where the paddle 346 allows the ball 112 to release from the ball release 338. Upon reaching the position, the switch 363 may close and connect a circuit to send a signal to the computer system 360 indicating a ball release has occurred. This may cause the computer system 360 to stop activating the driver 342. The computer system 360 may have electronics and/or software capable of controlling the sequence of operation of the driver system 343. The computer system 360 may optionally connect to an external source, such as the surface unit 115 (FIG. 1) for communication therewith and/or to use the computer capabilities of the surface unit 115. A delay may be built into the computer system 360 to ensure that only one ball 112 is released per activation of the driver system 343.

Figure 4:
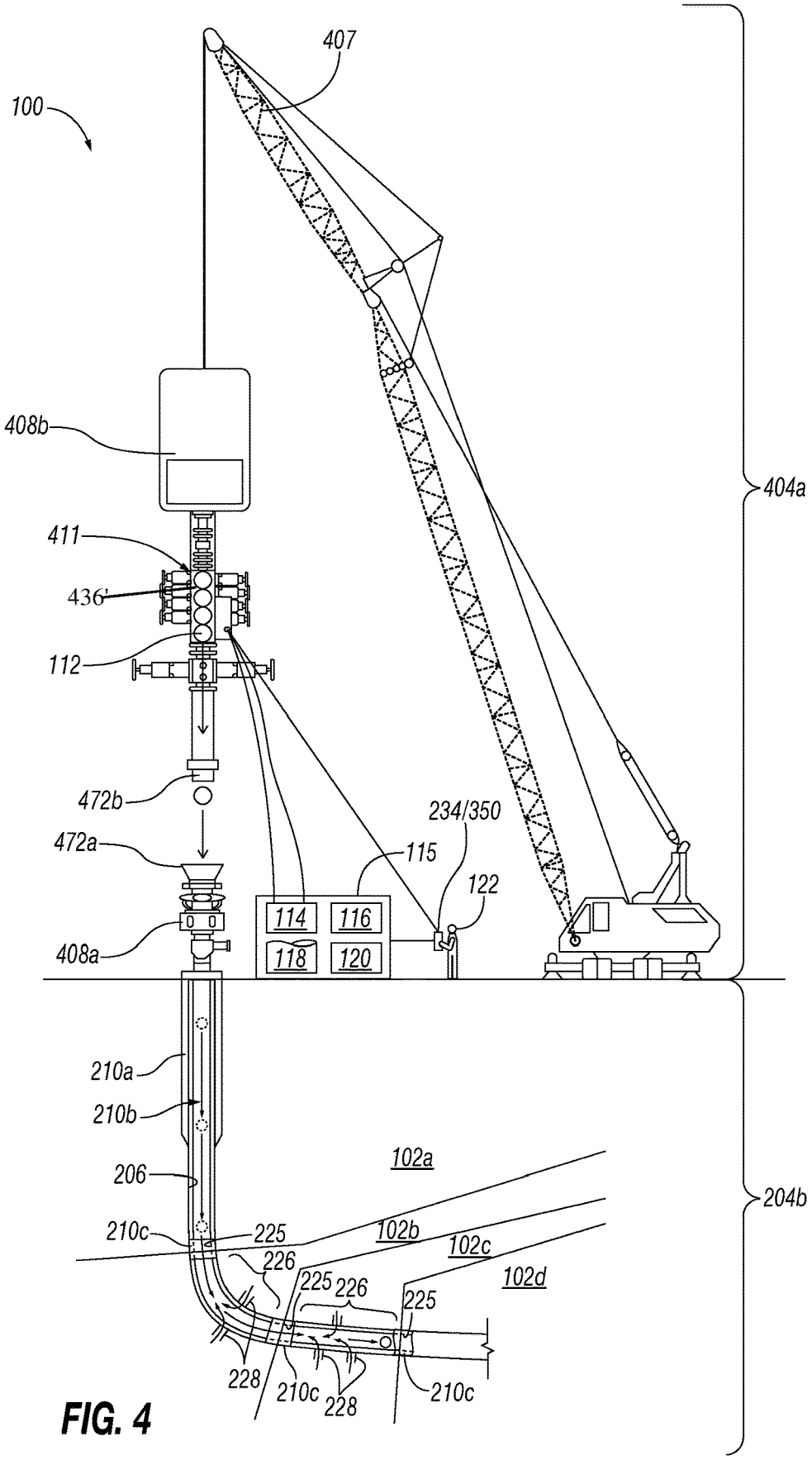
FIG. 4 is a schematic diagram of the wellsite having the wellsite equipment including a ball launcher with a housing extension.

FIG. 4 is a schematic diagram of the wellsite 100 with surface equipment 404*a* and the downhole equipment 204*b*. The downhole equipment 204*b* is the same as in FIGS. 2A and 2B. The surface equipment 404*a* is similar to the surface equipment 204*a* of FIGS. 2A and 2B, except that the surface equipment 404*a* includes a crane (hoisting equipment) 407, wellsite components 408*a,b*, and a ball launcher (wellsite actuator) 411. The crane 407 may be any lifting machine capable of lifting and positioning the wellsite components 408*a,b* and the ball launcher 411 about the wellsite 100.

The wellsite component 408*a* is depicted as a wellhead 408*a* positionable about a wellbore 206. The wellhead 408*a* may have a funnel shaped inlet 472*a* shaped to receive the wellsite component 408*b*. The inlet of the wellhead 408*a* may be shaped to correspond to a mated end of the wellsite component 408*b*. The wellsite component 408*b* may be, for example, a low riser package (LRP) including one or more blowout preventers. The LRP is also provided with connections, such as a wellhead connector 472*b* receivable by the funnel inlet 472*a* of the wellhead 408*a*. The wellhead connector 472*b* may be positioned by the crane 407 adjacent to the inlet 472*a* of the wellhead 408*a* for connection therewith, or remain a distance there from during operation.

The ball launcher 411 may be connected to the LRP for deploying (e.g., dropping) the balls 112 through the wellhead 408*a* and into the wellbore 206. The crane 407 may be used to movably position the wellsite component 408*b* with the ball launcher 411 thereon about the inlet 472*a* of the wellhead 408*a*. The crane 407 may carry the ball launcher 411 by itself, on the wellsite component 408*b*, and/or with other wellsite equipment from a remote location to the wellhead 408*a*. The crane 407 may support the ball launcher 411 a distance above the inlet 472*a* to drop the balls 112 from a distance into the wellbore 206. The ball launcher 411 may be provided with a housing extension 436' shaped to facilitate dropping of the balls 112 into the wellhead 408*a* as is described further herein.

The surface and downhole equipment 404*a*,204*b* may be coupled to the surface unit 115 for operation therewith. The surface unit 115 may be in communication with the ball launcher 411 directly or via the activator 234/350 usable by the operator 122 for selective operation therewith and/or to monitor performance thereof in a similar manner described with respect to FIGS. 2A-2B (and 3A-3C).

While a crane 407 is shown lifting the wellsite actuator 411 and the wellsite component 408*b*, the wellsite actuator 411 alone may be light enough in weight (e.g., under 50 lbs (23 kg)) for lifting and carrying by a single person. Installation and un-installation of the wellsite actuator 411 may be done by lowering the wellsite component 408*b* to the ground using the crane 407, and lifting the wellsite actuator 411 off of the wellsite component 408*b*.

Figure 5:
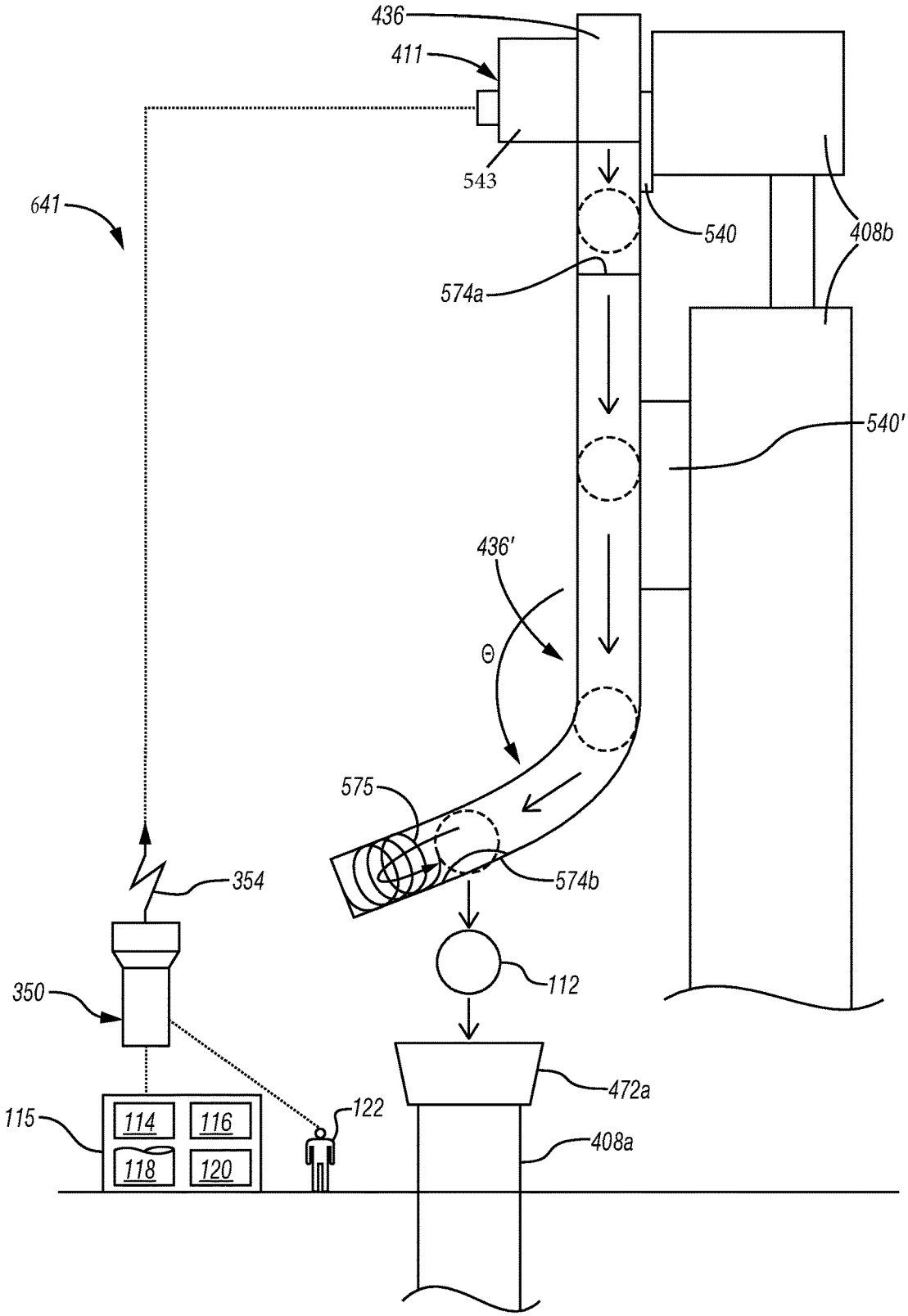
FIG. 5 is a schematic diagram of the ball launcher of FIG. 4.

FIG. 5 shows an example launching systems 541 including the ball launcher 411 and a housing extension 436'. The ball launcher 411 may be secured by bracket 540 to the wellsite component 408*b*, and placed in communication with the surface unit 115 via the activator 350 as previously described. The ball launcher 411 may include a housing 436 and a driver system 543 as is described further herein. While the ball launcher 411 is depicted, the housing extension 436' may be used with any ball launcher, such as the ball launchers 211, 311 of FIGS. 2A-3B, or other ball launchers.

The housing extension 436' is positioned at an outlet of the housing 436 of the ball launcher 411. The housing extension 436' is a tubular member with a curved shape. A lower end of the tubular member is at an angle from an upper portion of the tubular member. The lower end may be movably positioned to extend from the wellsite component 408*b*.

The housing extension 436' may have an inlet 574*a* at a top end and an exit 574*b* about a bottom of the housing extension 436'. The housing extension 436' may be shaped to allow the balls 112 to gravitationally fall through the housing extension 436' and out the exit 574*b*. The exit 574*b* may be located at various portions of the housing extension 436'. For example, the exit 574*b* may be positioned along a bottom surface of the lower end of the housing extension 436' to allow release of the ball 112 into the wellhead 408*a*.

The bracket 540' may be provided to adjustably secure the housing extension 436' to the wellsite component 408*b*. The bracket 540' may to allow the ball launcher 411 to be movably positioned (e.g., vertically, laterally, etc.) about the housing 436 of the ball launcher 411 and/or about the wellhead 408*a*. The exit 574*b* of the housing extension 436' may be positioned for placement of the ball 112 in the wellhead 408*a*.

The housing extension 436' may be shaped (e.g., curved) to slow a speed of the balls 112 (e.g., by friction) as they pass through the housing extension 436'. The housing extension 436' may be shaped to provide a desired reduction in velocity and/or for positioning about the wellhead 408*a*. The housing extension 436' may also be shaped to position the balls to drop from the housing extension 436' and into the wellhead 408*a*. For example, the housing extension 436' may have a vertical upper end and a deviated lower end with an angle θ therebetween. The angle θ may be, for example, greater than about 90 degrees.

The housing extension 436' may be provided with a spring 575 about the lower end of the housing extension 436'. The spring 575 may be used to further slow the balls 112, to terminate movement of the balls 112, and/or to provide a soft landing for the balls 112. The spring 575 may also be used to engage the ball 112, and reverse a direction of the ball 112 as it falls so it may reach a position where a vertical velocity of the ball 112 is about zero. The exit 574*b* may be placed at this location so that the ball 112 drops out of the exit at nearly zero vertical velocity from a height of less than about 2 feet (60.96 cm) above the inlet 472*a*.

The housing extension 436' may be configured for positioning vertically above the funnel inlet 472*a*. The funnel inlet 472*a* may be, for example, about 2 feet (60.96 cm) in diameter. The ball 112 may be released from the ball launcher 411 and/or the housing extension 436' from a height of, for example, less than about 5 feet (152.40 cm) above the funnel inlet 472*a*. If the ball 112 is released from height more than about 2 feet (60.96 cm) above the funnel inlet 472*a*, the ball launcher 411 may be provided with the housing extension 436' as a means of reducing a vertical velocity of the ball 112 during operation.

Figure 6:
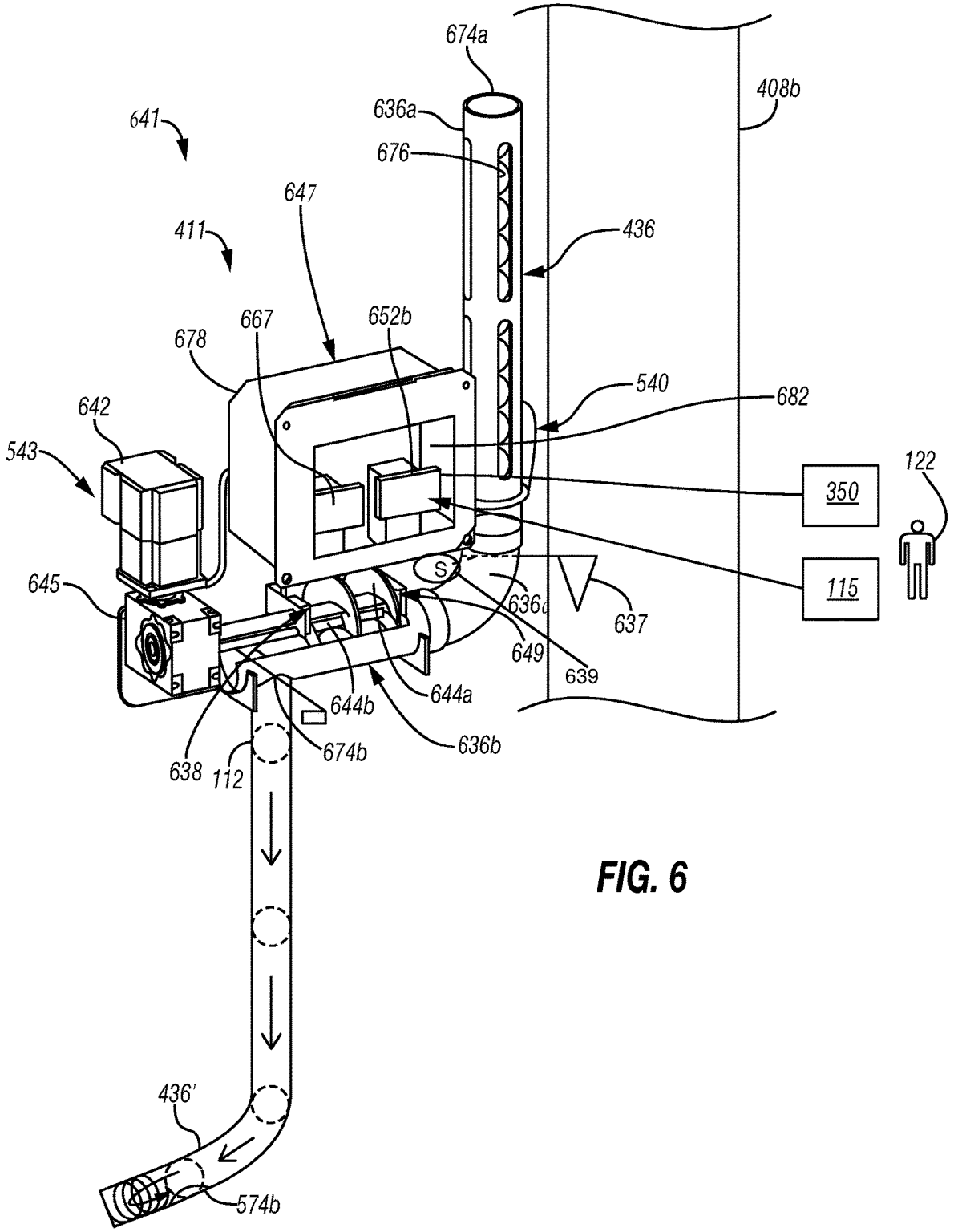
FIG. 6 is a perspective of the ball launcher of FIG. 4 in an auger configuration.
Figure 7A:
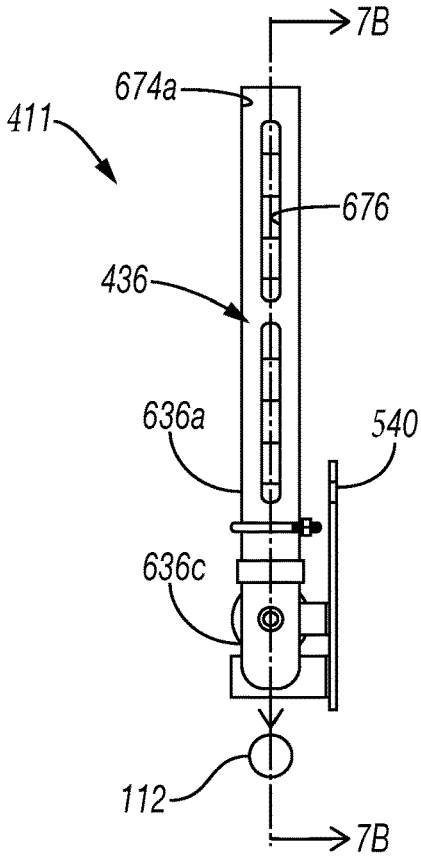
FIGS. 7A-7C are detailed views of portions of the ball launcher of FIG. 6.
Figure 7B:
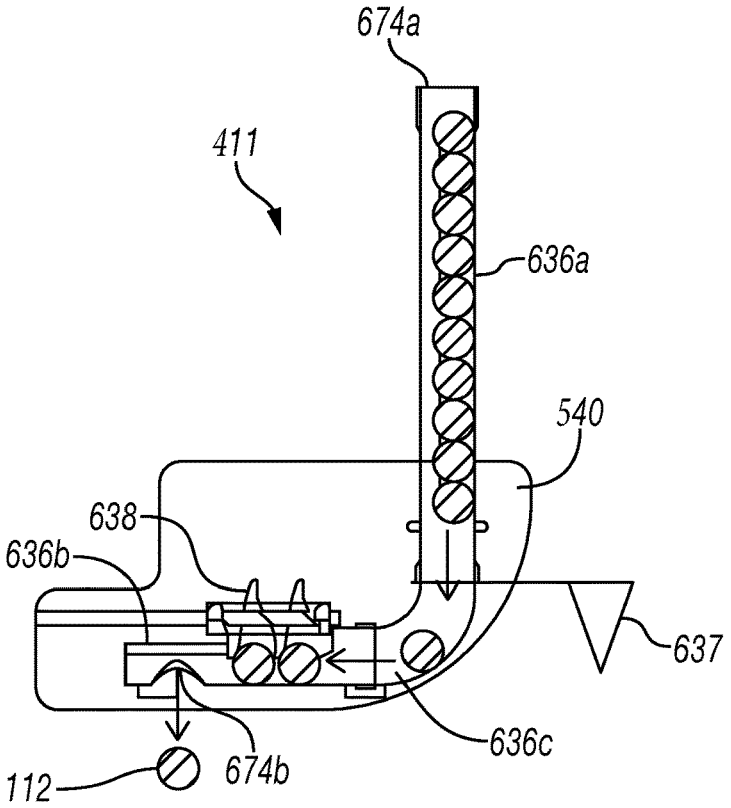
Figure 7C:
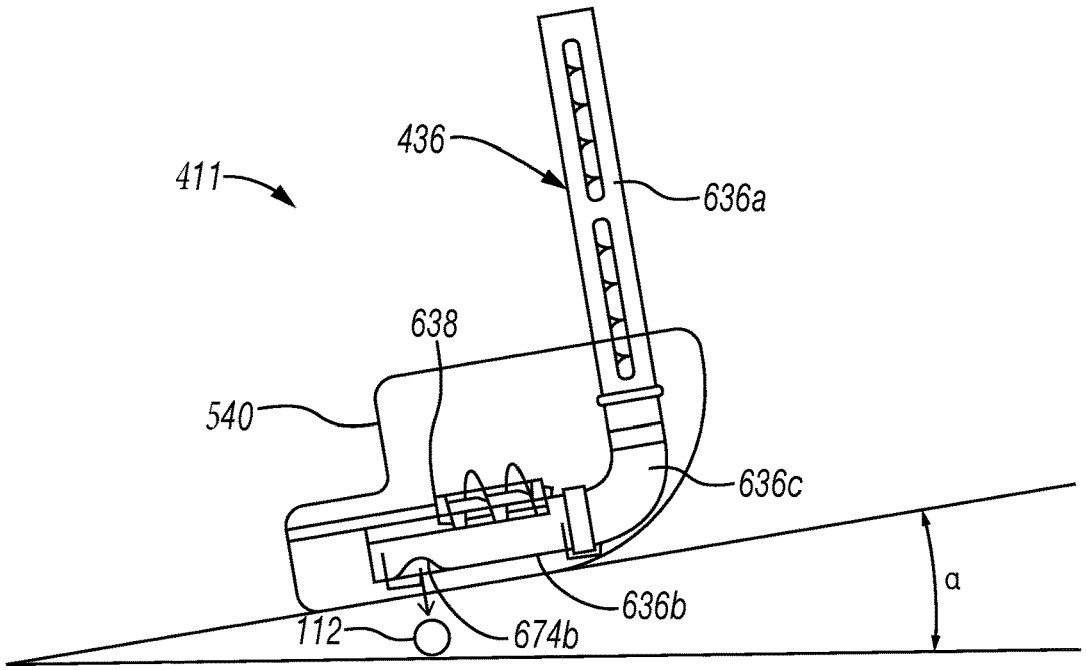

FIGS. 6-7C shows the launching system 641 in greater detail. FIG. 6 shows a perspective view of the launching system 641. FIGS. 7A-7C show rear, cross-sectional, and side views, respectively, of portions of the ball launcher 411. FIG. 7B is a cross-sectional view of the ball launcher 411 of FIG. 7A taken along line 7B-7B. FIG. 7C is a side view of the ball launcher 411 positioned at an angle α.

The ball launcher 411 includes the bracket 540, the housing 436, a ball release 638, and a drive system 543. The ball launcher 411 may be removably mounted to the wellsite component 408*b* by the bracket 540. The bracket 540 is plate shaped to support the components of the ball launcher 411 on the wellsite component 408*b*.

The housing 436 includes a hopper tube 636*a*, a feed tube 636*b*, and an elbow 636*c*. The hopper tube 636*a* is at an upper end of the housing 436, and is positioned vertically about the wellsite component 408*b*. The hopper tube 636*a* has an inlet 674*a*, which is shaped to receive the balls 112, and has slots 676 therethrough. The hopper tube 636*a* may be transparent or have transparent sections, such as the slots 676, that allow the operator to visually see if there are balls 112 remaining, and how many. Part or all of the housing 436, such as the feed tube 636*b*, might be flexible to prevent breakage and/or to allow for positioning.

The balls 112 may or may not be of the same configuration (e.g., the same diameter, same material, same density, etc.). From one application to the next, the ball diameter, material and density can change. A range of ball diameters from about 2 inches (5.08 cm) to about 4 inches (10.16 cm) may be used. The hopper tube 636*a* may hold a minimum of, for example, twelve of the balls 112. One or more of the hopper tubes 636*a* may be provided and interchanged with the ball launcher 411 to provide a range of ball configurations.

The feed tube 636*b* is positioned about a lower end of the housing 636, and extends laterally from the wellsite component 408*b*. The feed tube 636*b* is a tubular member with a portion removed to receive the ball release 638. The ball release 638 includes a feeder 649 and a driver 642. In this example, the feeder 649 may be an auger (or screw) positioned longitudinally in the feed tube 636*b*. The auger 649 has a spiral blade 644*a* helically positioned about a shaft 644*b*. The spiral blade 644*a* is shaped (and/or pitched) to receive one of the balls 112 at a time. As the blade rotates, the ball 112 is advanced axially through the feed tube 636*b* to the exit 674*b*. The housing extension 436' may be provided at the exit 674*b* to receive the ball 112 therethrough.

The shaft 644*b* of the auger 649 may be rotationally driven by the drive system 543. The drive system 543 includes the motor (driver) 642, a gearbox 645, and an indication unit 647. The motor 642 drives the gearbox 645 to rotate the shaft 644*b* of the auger 649, thereby rotationally driving the blade 644*a* to advance the ball 112 to the exit 674*b*. The driver 642 may be cycled between positions to selectively rotate the shaft 644*b* to permit release of the balls 112 as desired. As indicated by FIG. 7C, the bracket 540 and/or the housing 436 may be positioned at the angle α to facilitate travel of the ball 112 through the housing 436 to exit 674*b* and/or to facilitate engagement of the ball 112 with the auger 649.

Figure 8:
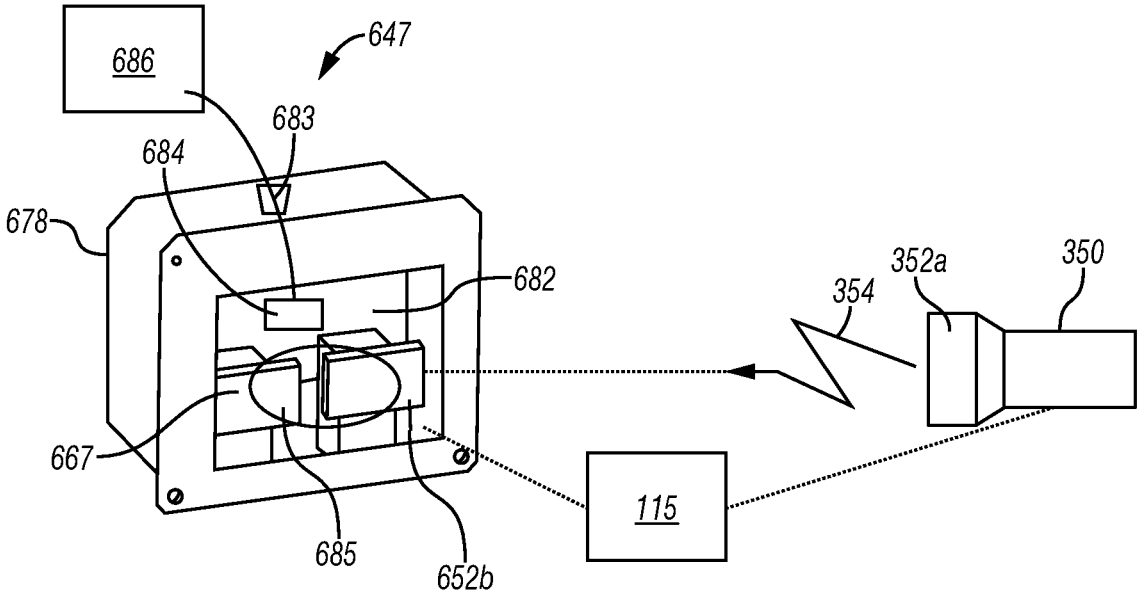
FIG. 8 is a schematic view of an indicator unit.

As shown in FIGS. 6 and 8, the indication unit 647 may be removably mounted onto the bracket 540 along with the ball launcher 411. The indication unit 647 includes an enclosure 678, the receiver 652*b*, and the indicator 667. The enclosure 678 may be a metal unit with an opening, and a window 682 positioned over the opening. The enclosure 678 may be explosion proof container capable of meeting oilfield safety standards for a hazardous location, such as a wellhead.

The window 682 may be a glass, plastic, or other material capable of protecting the components within the enclosure 678, while allowing signals, such as 354 to pass through. The indication units 647 and its contents may be removable for replacement/repair. The window 682 may allow passage of visible light or near infra-red or ultraviolet light, or some combination of these, in either direction. This window is normally flat, and may be circular, square or rectangular. The size of the window 682 may be defined to encompass the receiver 652*b* and the indicator 667 within the enclosure 678, and to receive signals 354.

As shown in the version of FIG. 8, the window 682 may include a lens 685 affixed to the exterior of the enclosure 678 without any compromise to its safety and/or certification. When the signal 354 from the activator 350 reaches the lens 685, the signal 354 may be focused onto the receiver 652*b* by optical refraction of the lens 685.

The enclosure 678 may be shaped and positioned to support the receiver 652*b* and the indicator 667 therein for communication with the signal eye 352*a* of the activator 350. The receiver 652*b* may be capable of receiving the signal 354 and communicating with the indicator 667. Upon receipt of the signal 354, the receiver 652*b* may send another signal to the indicator 667 to send an alert (e.g., emit light, sound an alarm, etc.). The receiver 652*b* may also send a signal to the motor 642 to drive the gearbox 645 to drive the auger 649 and/or to a computer (e.g., 360 of FIG. 3A).

The enclosure 678 is also provided with electronics 684, such as a battery to power the receiver 652*b* and/or the indicator 667. The electronics 684 may also be used to power the motor 642 which, in turn, powers the gearbox 645. The electronics may also provide communication between the electronics 684 and the surface unit 115 (or other facility). The surface unit 115 may receive data and/or other signals from the indication unit 647. The surface unit may also be coupled to the activator 350 to send signals for the activator 350 and/or to perform other functions (e.g., providing power, communicating, etc.)

The indicator 667 may be connected to the receiver 652*b* to detect the activation signal 354 and/or release of the ball 112. Upon such detection, the indicator 667 may provide feedback (e.g., visual, aural, etc.) to the operator from within the enclosure. For example, a green light may be illuminated immediately following the transmission of a signal to release the ball 112, and to indicate the signal 354 was received. If a yellow light is illuminated, this may indicate that the battery has insufficient charge to power the motor/actuator and release a ball. If a red light is illuminated, this may indicate a fault or error in operation.

The indicator 667 may remain on for a given time period (e.g., about 60 seconds) to assure it is seen by the operator, or it may remain continuously illuminated (e.g., to indicate low power and/or a malfunction. An independent additional indicator may also be provided as described further herein.

The battery 684 may be removed from the enclosure 678 for recharging or replacement. The enclosure 678 may be provided with a plug 683 electrically connectable via a wire (or cable) to the battery 684 for recharging from an external unit 686 without removing the battery 684. This external unit 686 may have an additional receiver coupled to the motor 642 and gearbox 645 to activate the ball release 638 to release the ball 112, and an additional indicator to indicate when the ball release occurs. The external unit 686 may also be in communication with the surface unit 115 and/or the activator 350.

The surface unit 115, electronics 684, and/or the external unit 686 may operate continuously, or in a sleep mode to preserve the battery. The indicator unit 647 may have 'sleep mode' (low power use) when not in use until activated by the signal 354 (e.g., about 50% of the time), and a duty cycle when in operation mode. The indicator unit 647 may wake up periodically (e.g., every few seconds) to detect if an activation signal 354 is present. When the actuation signal 354 is present, the signal may be for a duration to release the ball 112 and indicate such release (e.g., for a duration of one or more cycles), and remain in sleep mode while the signal is not present.

The external unit 686 may be used as a redundant power source, controller, and/or indicator. As an additional indicator, the external unit 686 may also signal that a ball has released. The external unit 686 may be used alone or in combination with the surface unit 115 and/or the activator 350 to send a signal. The external unit 686 may send a separate signal and/or send a signal to the activator 350 to send a signal.

The external unit 686 may have other devices, such as a camera to transmit images to the operator to allow the operator to see the ball 112 release and/or enter the wellhead (108*a* of FIG. 1). Other release displays may be used to provide redundant indicators.

Figure 9:
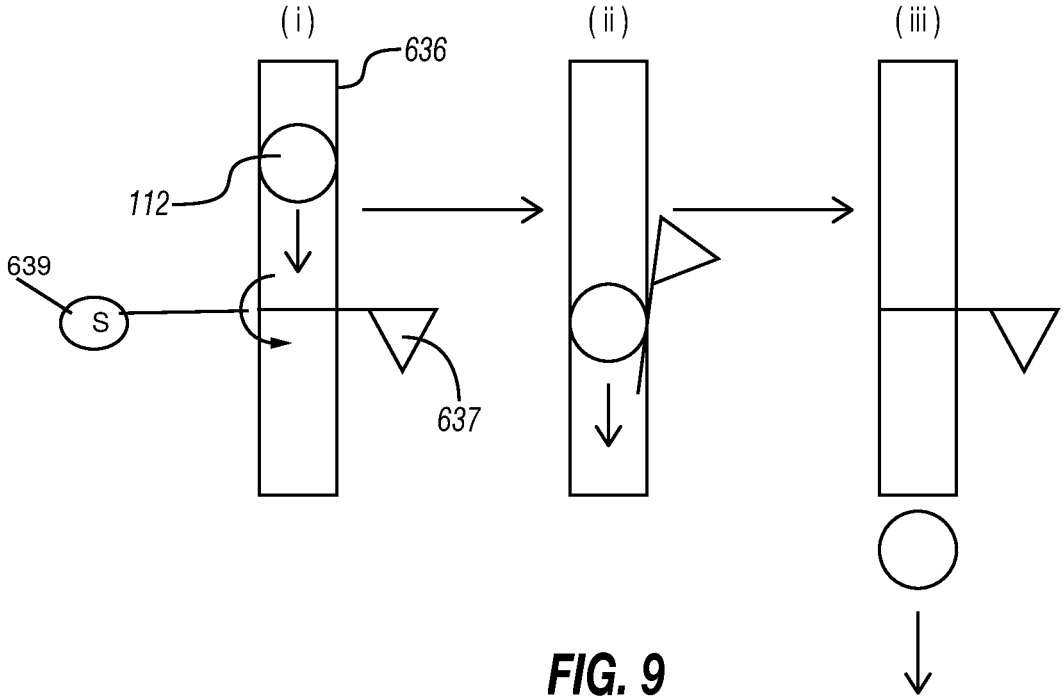
FIG. 9 is a schematic view of a flag indicator.

FIGS. 6 and 9 show an example release display 637 that may be used. The display 637 may be positioned anywhere along the housing 436 to identify when a ball 112 has been released. As shown by these figures, the display 637 may be a visual indicator, such a flag 637 that is movably positionable about the housing and engagable with balls 112 as they pass by. As shown by FIG. 9, the flag 637 may be in an inactive position (i) before the ball 112 passes by, move to an active position when (ii) the ball 112 engages the flag 637, and return to the inactive position (iii) after the ball 112 passes by. The sensor 639 as shown is coupled to the flag 637 to detect when the flag is activated.

The display 637 may include or be in the form of a sensor (S) 639. The sensor 639 may be coupled to the flag 637 as shown, or be activated by passage of the ball 112. The sensor 639 may be an electric, magnetic, or other type of sensor that operates as a proximity, detector, or other device capable of detecting passage of the ball 112 and/or the triggering (or tripping) of the display 637. The sensor 639 may be supported by the housing 436 and/or the display 637. The sensor 639 may also be operatively coupled to the elbow 636*c* and/or the display 637 for operation therewith, and/or operatively coupled (e.g., by wire or wireless connection) to a remote source for signaling detected activity. The sensor 639 may be, for example, an electrical sensor capable of sending a signal indicating a launch and/or other information concerning the launching system 641, the ball 112, and/or other items.

During operation, the operator 122 may be located at various locations about the wellsite 100, such as at a distance (e.g., 90 feet (27.43 m)) and/or from a different elevation (e.g., about 40 degrees from horizontal and/or about +/−30 degrees azimuth) relative to the ball launcher 411. The indication unit 647 may be omni-directional, i.e. capable of receiving the signal 354 from the operator 122 regardless of such location. The operator may send the signal 354 to the indication unit 647 via the receiver 652*b*. The signal may be sent via a wire or wirelessly via the activator 350 and/or the surface unit 115. The signal is received by the receiver 652*b* which then sends a signal to the motor 642 and gearbox 645 to activate the auger 649 to cycle and release the ball 112. Once released, the indication unit may use the indicator 667 and/or the flag 637 to indicate that a ball was released (e.g., ignite a light and/or move the flag).

Due to certain safety regulations at the wellsite 100, certain equipment, such as electrical equipment may be required to undergo certifications prior to use. For example, the launching system 641 and its electrical and/or other components may be required to obtain certification by an approved authority to qualify for certain safety classifications, such as 'intrinsically safe' in Class I, Div 1 area classification at the wellsite 100 according to industry safety standards. In at least some cases, the enclosure 678 may be made to 'explosion proof' standards (e.g., with certain grade materials and/or protections) which may permit the launching system 641. Once certified as 'explosion proof', the contents therein may be able to forego certification requirements to meet 'intrinsically safe' classification.

The launching system 641 may be operable in a variety of conditions, such as outdoor conditions at atmospheric pressure, in a temperature range of from about −10 C to about +45 C and at any relative humidity. The electronics 684 may be provided with screens, shades, fans, insulation, or heaters to further protect the components in enclosure 678.

The launching system 641 may be operable in daytime as well as nighttime, during sunlight or dark. The launching system 641 may be operable even in strong sunlight, and be capable of distinguishing sunlight from the detected signals 354. The launching system 641 may also be weather (e.g., rain, snow, etc.), lightning, shock, and vibration resistant. For example, the launching system 641 may have coatings and/or heaters to prevent ice from forming on it.

Figure 10:
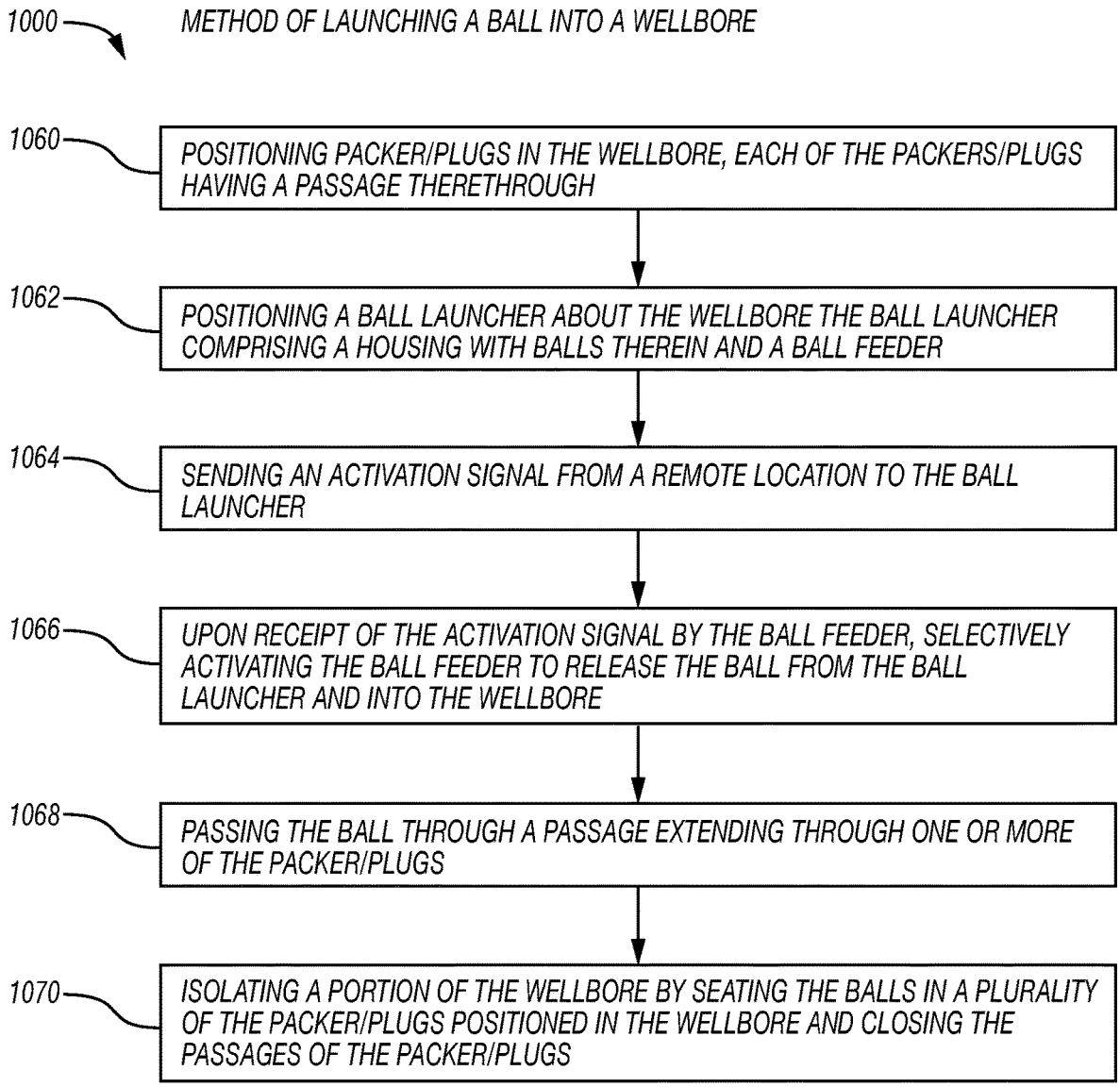
FIG. 10 is a flow chart depicting a method of launching a ball into a wellbore.
Figure 11:
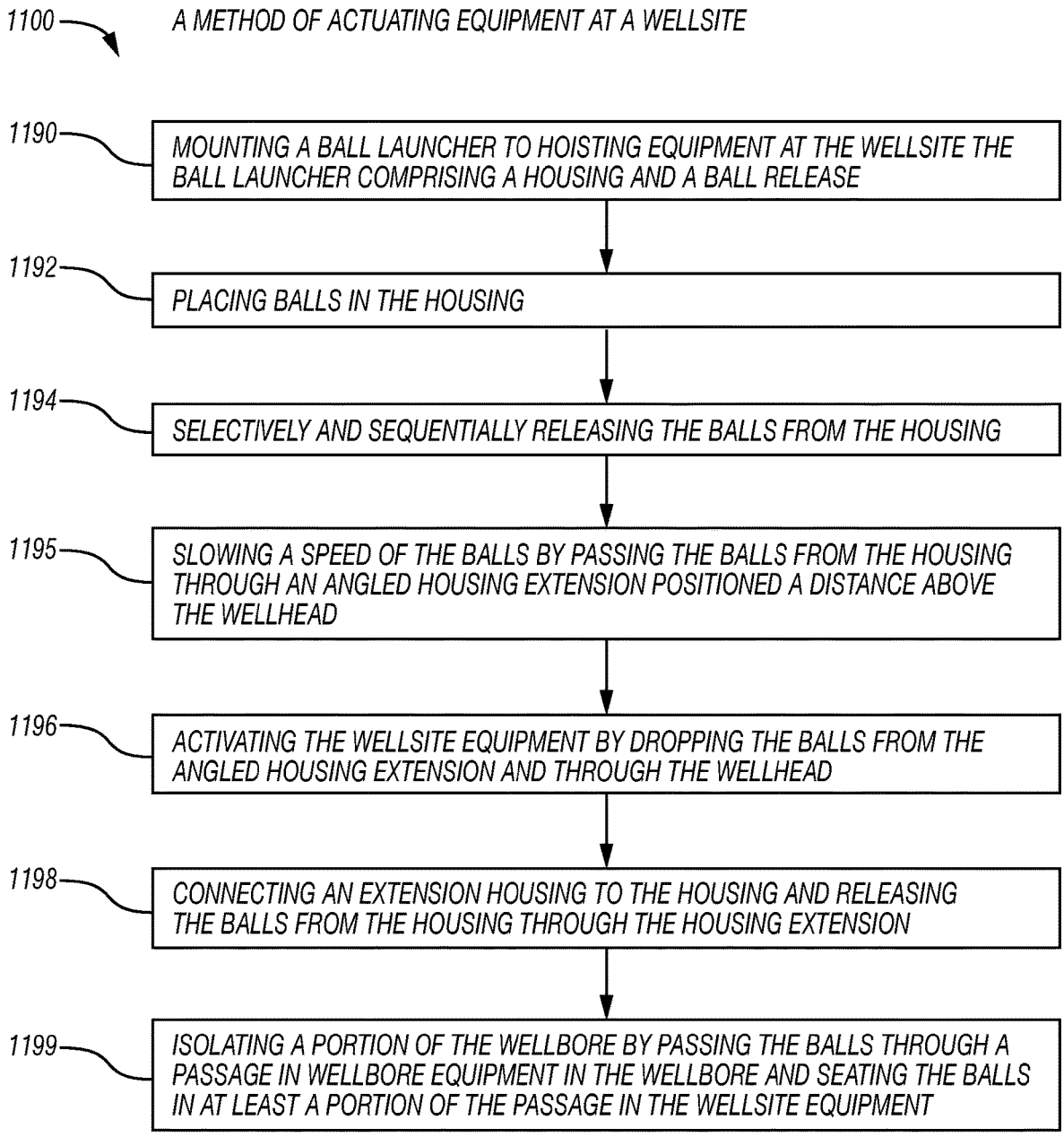
FIG. 11 is a flow chart depicting a method of actuating equipment at a wellsite.

FIGS. 10 and 11 show methods that may be used with the wellsite actuators and/or ball launchers herein. FIG. 10 shows a method 1000 of launching a ball into a wellbore. The method involves 1060 positioning packers/plugs in the wellbore. The packers/plugs may be deployed by a tubing, wireline, slickline, coil tubing, and/or downhole tool into the wellbore (see, e.g., FIGS. 2A and 2B). Each of the packers/plugs may have a passage therethrough. The method continues with 1062 positioning a ball launcher about a wellbore at a wellsite. The ball launcher may have a housing with balls therein and a ball feeder (see, e.g., FIGS. 3A-3B).

The method continues with 1064 sending an activation signal from a remote location to the ball launcher. The signal may be sent, for example, by a remote signal as shown in FIGS. 3A-3B. The method continues with 1066—upon receipt of the activation signal by the ball feeder, selectively releasing the ball from the ball launcher and into the wellbore, 1068—passing the ball through a passage extending through one or more of the packers/plugs, and 1070 isolating a portion of the wellbore by seating the balls in the passage of a plurality of the packers/plugs positioned in the wellbore and closing the passages of the packers.

FIG. 11 shows a method 1100 of actuating equipment at a wellsite (see, e.g., FIGS. 1, 2A-2B, 4). The method 1100 involves 1190—mounting a ball launcher to hoisting equipment (see, e.g., crane 407 of FIG. 4) at the wellsite. The ball launcher comprises a housing and a ball release (see, e.g., 411 of FIG. 4). The method continues with 1192—placing balls in the housing (see, e.g., 436 of FIG. 6), 1194—selectively and sequentially releasing the balls from the housing (see, e.g., FIG. 4), and 1195—slowing a speed of the balls by passing the balls from the housing through an angled housing extension positioned a distance above the wellhead (see, e.g., FIGS. 5A and 5B).

The method continues with 1196—activating the wellsite equipment by dropping the balls from the angled housing extension and through the wellhead (see, e.g., 354 of FIGS. 5A and 5B), and 1198—connecting an extension housing to the housing and releasing the balls from the housing through the housing extension (see, e.g., FIGS. 2A and 2B). The method 1100 may also include 1199—isolating a portion of the wellbore by passing the balls through a passage in wellbore equipment in the wellbore and seating the balls in at least a portion of the passage in the wellsite equipment (see, e.g., FIG. 2B).

The method may be performed in any order and repeated as desired. In an example application, the ball launcher to be operated during multistage wireline operations for improving efficiency and removing the need of personnel scaling the wellsite equipment for activation.

The above description is illustrative of the preferred embodiment and many modifications may be made by those skilled in the art without departing from the disclosure whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations, modifications, additions and improvements are possible, such as various combinations of the features and/or methods described herein.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A ball launcher for actuating wellsite equipment at a wellsite, the wellsite having wellhead equipment positioned at an inlet of a wellbore, the ball launcher comprising:

a housing comprising a hopper tube and a feed tube, the feed tube extending at an angle from an end of the hopper tube, a passage extending through the hopper tube and the feed tube to receive balls therethrough; and a ball release positionable about the housing, the ball release comprising a feeder to selectively and sequentially release the balls from the housing;

wherein the housing is disconnected from the wellhead equipment and wherein the feed tube has an exit a distance above the wellhead equipment to release the balls therethrough whereby the balls are dropped into and activate the wellsite equipment in the wellbore.

2. The ball launcher of claim 1, wherein the ball release further comprises a drive system.

3. The ball launcher of claim 2, wherein the feeder comprises an auger and the drive system comprises a motor and a gearbox.

4. The ball launcher of claim 2, wherein the feeder comprises a rotary wheel and the drive system comprises a motor.

5. The ball launcher of claim 1, further comprising an indication unit operatively connected to the housing, the indication unit comprising an enclosure, a receiver, a signal indicator, and a battery.

6. The ball launcher of claim 5, wherein the enclosure comprises an explosion proof chamber with an opening and a window positioned over the opening.

7. The ball launcher of claim 5, further comprising an external unit comprising a charging unit connectable to the battery.

8. The ball launcher of claim 1, further comprising a ball release indicator, the ball release indicator positioned about the housing and movable to an activation position by each of the balls passing thereby.

9. The ball launcher of claim 1, further comprising a mounting bracket secured to the housing.

10. The ball launcher of claim 1, further comprising a housing extension connected to the exit of the feed tube.

11. An activation system for actuating wellsite equipment at a wellsite, the wellsite having wellhead equipment positioned at an inlet of a wellbore, the activation system comprising:

balls;

hoisting equipment positionable about the wellsite; and a ball launcher carried by the hoisting equipment, the ball launcher comprising:

a housing comprising a hopper tube and a feed tube, the feed tube extending at an angle from an end of the hopper tube, a passage extending through the hopper tube and the feed tube to receive the balls therethrough; and a ball release positionable about the housing, the ball release comprising a feeder to selectively and sequentially release the balls from the housing;

wherein the housing is disconnected from the wellhead equipment and wherein the feed tube has an exit a distance above the wellhead equipment to release the balls therethrough whereby the balls are dropped into and activate the wellsite equipment in the wellbore.

12. The activation system of claim 11, further comprising a remote activator to send a release signal to the ball release.

13. The activation system of claim 12, further comprising an indication unit comprising a receiver to receive the release signal and a driver coupled to the receiver, the driver comprising a motor to drive the feeder in response to the release signal.

14. The activation system of claim 12, further comprising an external unit in communication with the remote activator.

15. The activation system of claim 11, further comprising a surface unit coupled to the ball release, the surface unit comprising a processor, a database, and a transceiver.

16. The activation system of claim 11, wherein the wellsite equipment comprises packers positioned in the wellbore at the wellsite, each of the packers having a passage to receive the balls.

17. A method of actuating wellsite equipment at a wellsite, the wellsite having wellhead equipment positioned at an inlet of a wellbore, the method comprising:

placing balls in a housing;

slowing a speed of the balls by passing the balls through an angled portion of the housing; and activating the wellsite equipment by selectively and sequentially releasing the balls to drop from the housing a distance above the wellhead equipment and into the wellhead equipment, the housing disconnected from the wellhead equipment.

18. The method of claim 17, further comprising connecting a housing extension to an exit of the housing and releasing the balls from the housing through the housing extension.

19. The method of claim 17, wherein the selectively releasing comprises sending an activation signal from a remote location to the housing.

20. The method of claim 17, further comprising isolating a portion of the wellbore by passing the balls through a passage in the wellsite equipment in the wellbore and seating the balls in at least a portion of the passage in the wellsite equipment.

* * * * *